US008232710B2

(12) United States Patent
Deng

(10) Patent No.: US 8,232,710 B2
(45) Date of Patent: Jul. 31, 2012

(54) MULTI-FUNCTIONAL MINI-REFLECTOR IN A CERAMIC METAL HALIDE LAMP

(75) Inventor: Lei Deng, Solon, OH (US)

(73) Assignee: General Electric Company, Schenectady, NY (US)

( * ) Notice: Subject to any disclaimer, the term of this patent is extended or adjusted under 35 U.S.C. 154(b) by 10 days.

(21) Appl. No.: 12/947,500

(22) Filed: Nov. 16, 2010

(65) Prior Publication Data

US 2012/0119637 A1 May 17, 2012

(51) Int. Cl.
*H01T 13/46* (2006.01)

(52) U.S. Cl. ... 313/114; 313/113; 313/623; 313/318.12; 362/341; 362/346

(58) Field of Classification Search ..... 313/113–115, 313/318.11, 623–625, 634–636, 493, 318.12, 313/570; 118/50; 362/261, 341, 346
See application file for complete search history.

(56) References Cited

U.S. PATENT DOCUMENTS

| | | | | |
|---|---|---|---|---|
| 4,179,640 | A | 12/1979 | Larson et al. | |
| 5,272,407 | A * | 12/1993 | Tillman et al. | 313/25 |
| 6,411,036 | B1 | 6/2002 | Bugenske | |
| 6,744,187 | B1 * | 6/2004 | Wimberly | 313/110 |
| 7,355,328 | B2 * | 4/2008 | Botzer et al. | 313/114 |
| 7,852,004 | B2 * | 12/2010 | Li et al. | 313/594 |
| 7,923,908 | B2 * | 4/2011 | Lapatovich | 313/113 |
| 2003/0062831 | A1 | 4/2003 | Alderman et al. | |
| 2004/0061441 | A1 * | 4/2004 | Johanning et al. | 313/567 |
| 2005/0206319 | A1 * | 9/2005 | Botzer et al. | 313/634 |
| 2009/0284153 | A1 | 11/2009 | Lapatovich et al. | |
| 2009/0323350 | A1 * | 12/2009 | Deng et al. | 362/296.01 |

FOREIGN PATENT DOCUMENTS

| | | | |
|---|---|---|---|
| EP | 1 503 400 | A2 | 2/2005 |
| EP | 1594157 | A2 | 11/2005 |
| EP | 2034509 | A1 | 3/2009 |
| GB | 494192 | | 10/1938 |

OTHER PUBLICATIONS

PCT Search Report and Written Opinion dated Mar. 6, 2012 from corresponding Application No. PCT/US2011/057185.

* cited by examiner

*Primary Examiner* — Peter Macchiarolo
(74) *Attorney, Agent, or Firm* — Fay Sharpe LLP

(57) ABSTRACT

A light assembly includes a metal halide light source having an arc tube with first and second legs extending from a discharge chamber. A light transmissive capsule surrounds the light source. A reflector is received in the capsule and has a large diameter, annular first portion that receives light from the discharge chamber and is dimensioned to operatively engage an inner surface of the capsule to mount the reflector assembly and light source relative to the capsule. In addition, a small diameter portion of the reflector assembly is received around the first leg. By electrically interconnecting the reflector with the second electrode assembly, namely the support leg, and positioning the small diameter portion closer to the first electrode assembly than the dimension between the electrode terminal ends allows the reflector to also serve as an ignition aid. The reflector is formed of a material that serves as a heat shield for the seal glass in the first leg and also serves as a heat shield for the capsule seal region.

20 Claims, 2 Drawing Sheets

MULTI-FUNCTIONAL MINI-REFLECTOR IN A CERAMIC METAL HALIDE LAMP

BACKGROUND OF THE DISCLOSURE

The disclosure relates to a lamp assembly, and more particularly to a ceramic metal halide (CMH) lamp assembly, that incorporates a reflector configured to provide multiple functions.

High intensity discharge lamps require high ignition voltages to break down a gap and initiate an arc between spaced electrodes. One example of a discharge lamp is a CMH lamp having an arc tube having first and second legs extending from axially opposite ends. Electrode assemblies are received in the respective legs and terminal ends of the electrode assemblies are spaced apart in the discharge chamber of the arc tube. Typically, the CMH lamp is received in a sealed shroud or capsule and includes a pinch or press seal region at one end in which molybdenum seals are mechanically and electrically interconnected at one end with respective inner leads that support the CMH light source and interconnect with the electrode assemblies, and at the other end with outer leads that mechanically and electrically connect with an associated power source.

These types of lamps require high ignition voltages to break down the gap and initiate an arc between the spaced electrodes. For example, an ignition pulse on the order of approximately 25 kV is required to start the lamp when the lamp is still hot; an ignition pulse on the order of 3 KV to 5 KV is required to start the lamp in normal condition (when the lamp is at room temperature). One conventional way to reduce starting difficulties is to fill the arc tube with radioactive krypton ($Kr_{85}$) gas which requires a special license that regulates its use. Another manner of reducing the starting voltage aid is taught in commonly owned U.S. application Ser. No. 11/810,471, filed Jun. 6, 2007 (193334-1/GECZ 200793US01), the disclosure of which is expressly incorporated herein by reference in its entirety. The ignition voltage aid device of that disclosure is spaced closer to one of the electrodes than the arc gap dimension between the electrodes in order to significantly reduce the starting voltage for the lamp.

A CMH lamp has a very significant amount of backlight (approximately thirty percent (30%) of the emitted light) that is typically wasted. Generally, the wasted light is associated with that portion of the emitted light that is directed toward the pinch region.

In addition, overall reliability of the CMH lamp is dependent on and sensitive to the base end seal glass temperature. That is, the seal glass temperature of the base end (pinch region) is usually higher than the dome end of the surrounding capsule when the lamp is mounted at base up position. In addition, the capsule pinch temperature, especially for a higher wattage lamp, is very sensitive and thus adversely impacts on lamp reliability if exceeding 300° C.

Still another issue is the difficulty in keeping the arc tube centered inside of the capsule during manufacture. This is important to optimize beam performance since precisely locating the arc discharge relative to the lamp capsule directly effects light output and light intensity distribution, and likewise maximum beam performance is based in part on the location of arc tube relative to the capsule.

In addition, it is important to precisely align the arc tube within the capsule so that relatively even temperatures are created in the sidewall of the capsule.

Thus, a need exists for a lamp that overcomes one or more of these needs in a manner that is economical, efficient, and easy to implement.

SUMMARY OF THE DISCLOSURE

A multi-functional reflector assembly is provided for a discharge lamp assembly. The lamp assembly includes a discharge light source received within a capsule. A reflector has a first portion that is a generally annular surface of revolution where an outer perimeter of the surface is dimensioned for operative engaging receipt with an inner diameter of the capsule to center the light source inside of the capsule. A second portion of the reflector is dimensioned for operative engaging receipt about one of the discharge lamp legs.

An enlarged end of the reflector is located adjacent the discharge chamber, and preferably axially spaced therefrom.

The reflector is preferably formed of an electrically conductive material so that the second portion or small diameter end of the reflector serves as a starting aid for the discharge chamber.

The reflector fills an annular region between the light source first leg and an inner surface of the capsule, and thereby also serves as a heat-shield to thermally protect a terminal end of the first leg of the light source.

The reflector is mechanically and electrically connected to a lead member that supports the second leg of the discharge light source.

The reflector is preferably formed of one of niobium or aluminum and further includes an IR reflective coating along a surface of the annular portion facing the discharge chamber.

A primary benefit of the lamp assembly is the provision of a reflector that is configured to serve multiple functions that improve lamp photometric performance, reliability, and standard conformance.

Another advantage is the ability to collect unusable backlight and project the collected light in a useful manner.

Yet another benefit resides in the starting aid associated with the multi-functional reflector configuration.

Still another feature is the ability to reduce a seal glass temperature of a base end and lamp base/pinch temperature through use of the reflector.

Yet another advantage resides in the ability to reduce eccentricity issues of the arc tube within the capsule.

Still other features and benefits of the disclosure will become apparent upon reading and understanding the following detailed description.

DETAILED DESCRIPTION OF THE PREFERRED EMBODIMENT

Figure 1:
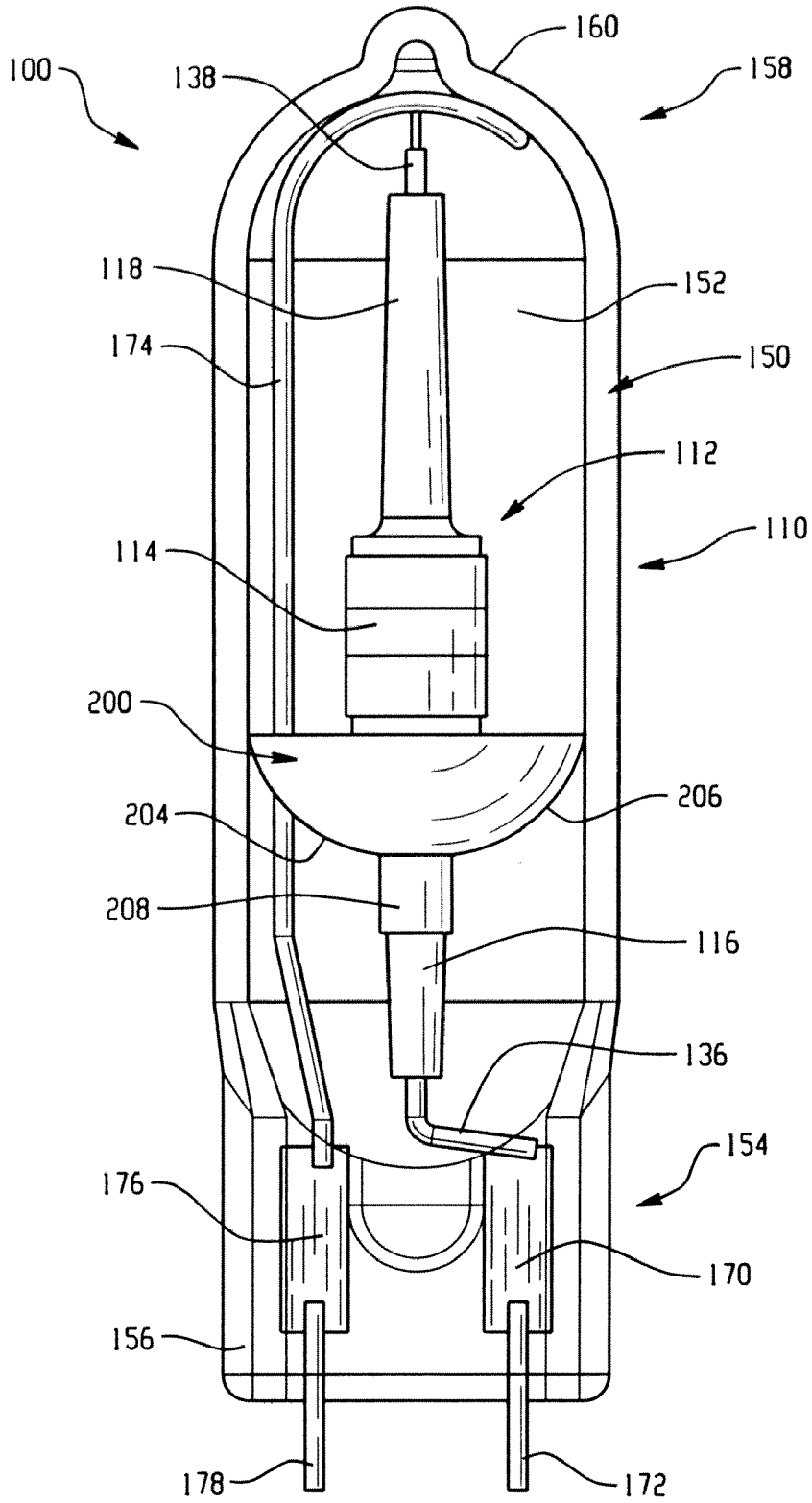
FIG. 1 is an elevational view of the new lamp assembly with the multi-functional reflector.
Figure 2:
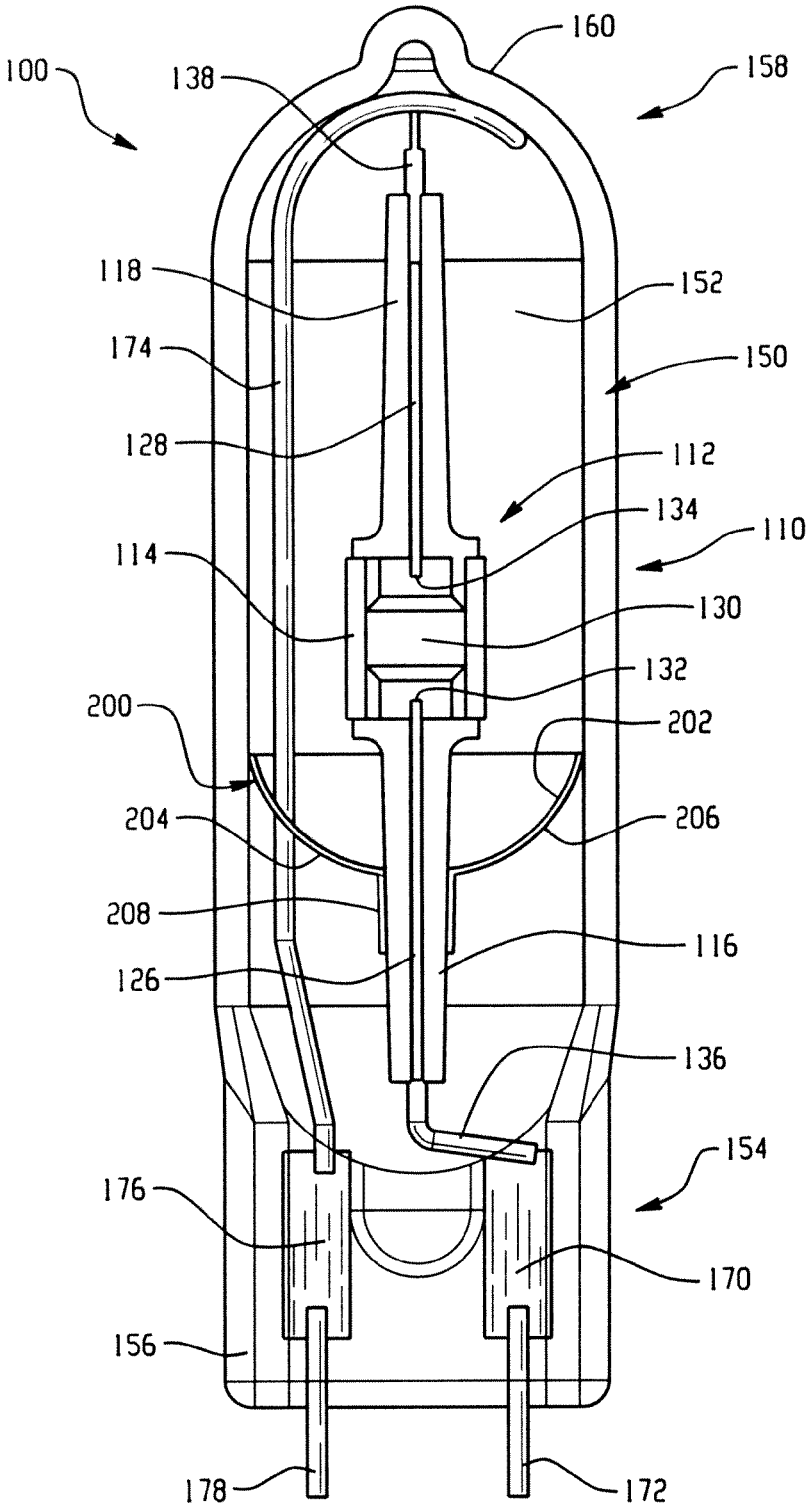
FIG. 2 is a view similar to FIG. 1 with selected portions of the lamp assembly shown in longitudinal cross-section.

FIGS. 1 and 2 show a lamp assembly, and more particularly a ceramic metal halide (CMH) lamp assembly 100. The lamp assembly 100 is a discharge or CMH discharge light source 110 that includes a light transmissive arc tube 112 having a central body 114 disposed between oppositely extending first and second legs 116, 118. As is generally known in the art, first and second electrode assemblies 126, 128 extend through the first and second legs 116, 118, respectively. Inner terminal ends of each electrode assembly define electrodes in a discharge space 130 formed in the central body and the terminal ends 132, 134 of the electrode assemblies are spaced apart by a preselected dimension or arc gap (FIG. 2). Outer ends of the respective electrode assemblies are connected to inner leads 136, 138, respectively.

A light transmissive outer shroud or capsule 150 has a cavity 152 dimensioned to receive the arc tube therein. A first or lower end 154 of the capsule includes a seal or pinch region 156 that has a generally planar conformation. A second or upper end 158 has a generally dome conformation 160. The cavity 152 is generally elongated so that a longitudinal axis of the capsule is generally coincident with the longitudinal axis defined by an axial extent of the first and second legs 116, 118 of the arc tube. Preferably, the arc tube is centered inside the capsule. To facilitate mounting of the arc tube in the capsule, inner lead 136 has a first end that extends from connection with the first electrode assembly and the inner lead extends into the pinch region 156 where a second end is mechanically and electrically connected with one end of a generally planar seal member that is also referred to as a first molybdenum foil 170. An opposite end of the molybdenum foil is likewise electrically and mechanically connected to a first end or an outer lead 172 that is received in the pinch region, and the outer lead has a second end that extends outwardly from the capsule for electrical and mechanical connection with an associated power source (not shown). Inner lead 138 is electrically and mechanically connected to the second electrode assembly 128 and includes an elongated support leg 174 that has a generally hook shape. That is, the elongated support leg has a curved end along the dome 160 and a generally linear portion that extends axially, and generally parallel to the longitudinal length of the arc tube for receipt in the seal region. The hook configuration of the support leg 174 provides for precision location and support at the second or upper end 158 of the capsule. The lower, opposite end of the support leg extends into the pinch region 156 where electrical and mechanical connection is established with a first end of a second generally planar seal member, also referred to as a second molybdenum foil 176. In the same manner, a second outer lead 178 has an inner end connected to a second end of the second molybdenum foil and the second outer lead extends outwardly from the pinch region 156 for connection with an associated power source. Generally, to this point, this detailed description of the CMH lamp assembly is conventional.

A multi-functional reflector 200 is incorporated into the CMH lamp assembly 100. Preferably, the reflector 200 is a niobium or aluminum structure that can withstand the high temperatures associated with the discharge light source and may include a visible or infrared (IR) reflective coating on a surface 202 of the reflector that faces the discharge chamber 130. More particularly, the reflector 200 has a first, reflective portion 204 that is preferably a generally annular surface of revolution having an enlarged diameter first end and a narrow diameter second end where an outer perimeter 206 the first portion 204 is dimensioned for operative engaging receipt with an inner diameter surface of the capsule 150. The shape of the reflective surface 202 of the first portion may be a simple hemisphere as illustrated or a more complex surface conformation or multiple conformations that directs light generally away from the pinch region of the lamp assembly where the light is otherwise wasted or unused and generally toward the dome 160 of the capsule. In this manner, the inner reflective surface 202 collects typically unusable backlight and directs the collected light outwardly through the capsule in order to increase the overall lumens emitted from the lamp assembly.

A second portion 208 of the reflector extends axially toward the pinch region from the narrow diameter end of the first portion. The reflector second portion 208 is dimensioned for close receipt over the outer surface of the first leg 116 of the arc tube. More specifically, the second portion 208 is generally cylindrical and has an axial dimension that extends along a portion of the first leg 116 of the arc tube. As a result of the outer perimeter of the reflector first portion 204 engaging the inner surface of the capsule, and the generally cylindrical second portion 208 operatively engaging the first leg which is supported adjacent the pinch region, arc tube eccentricity inside the capsule is eliminated. That is, the reflector 200 also functions as a mounting aid to stably position the arc tube within the capsule at the desired, substantially collinear or coincidental mounted arrangement.

In addition, the reflector 200 has an opening 220 disposed near the outer perimeter and extending through the first portion 204 that is received around the support leg 174 of inner lead 138 associated with the light source. The opening 220 makes electrical and mechanical contact with the support leg 174 so as to reduce the length of a breakdown path and serve as a conductive ignition aid or starting device for the lamp. That is, the dimension between the reflector second portion 208 and the electrode assembly 126 in the first leg of the arc tube is shorter than the gap between the first and second electrode terminal ends 132, 134 in the discharge space. The reduced dimension between the reflector and the electrode assembly allows reduced voltage to ignite discharge during startup. Because the lamp assembly can achieve ignition with the starting aid function provided by the reflector, use of $Kr_{85}$, a material typically incorporated into the fill gas sealed in the discharge space to reduce the starting voltage, can be eliminated from the discharge lamp.

Still another advantageous function provided by the reflector configuration is the heat shield benefit associated with the reflector. That is, positioning of the cylindrical second portion 208 of the reflector over the first leg of the arc tube, as well as the annular extent of the first portion 204 at a location between the pinch region 156 and the central body 114 of the arc tube, not only reflects the light but also serves to reflect and direct heat away from the first or lower end 154 of the capsule. The heat shield function provided by the reflector reduces the seal glass temperature and the lamp base/pinch temperature. Usually, the seal glass temperature at the base end is higher than the dome end of the lamp but incorporating the multi-functional reflector into the CMH lamp significantly reduces the seal glass temperature in this region. Reducing the temperature of the seal glass in this region contributes to longer life while centering of the light source within the capsule optimizes beam performance.

The enlarged end of the reflector assembly is spaced from the discharge member in the preferred embodiment in order to reflect the light output and direct the light to those optical regions where the light is most needed. The dimensioning of the annular portion 204 of the reflector assembly between the light source first leg and the inner surface of the capsule serves as an effective heat shield to thermally protect the terminal end of the first leg of the arc tube, and likewise thermally protect the pinch region of the seal capsule. Positioning the generally cylindrical reflector second portion 208 around the first leg, and electrically connecting the first, annular portion with the support leg 174 also advantageously allows the reflector to reduce the starting voltage necessary to break down and initiate the arc discharge.

One skilled in the art will appreciate that the reflector may adopt a different conformation, or that the reflector may only serve some of these functions rather than all of the enumerated functions described above. However, in the preferred arrangement all of these functions are achieved with a single device, and one that can be easily incorporated into the assembly.

The disclosure has been described with reference to the preferred embodiment. Obviously, modifications and alterations will occur to others upon reading and understanding the preceding detailed description. It is intended that the disclosure be construed as including all such modifications and alterations.

What is claimed is:

1. A light assembly comprising:

a discharge light source that includes a discharge chamber having a leg extending therefrom and received in a surrounding capsule;

a reflector having a first portion that includes a generally annular surface of revolution a reflector second portion dimensioned for operative engaging receipt about the discharge light source leg for receipt of light from the discharge chamber; and wherein the reflector is electrically connected to the lead member.

2. The light assembly of claim 1 wherein the reflector has an outer perimeter dimensioned for operative engaging receipt with an inner diameter of the capsule for centering the associated lamp inside the capsule.

3. The light assembly of claim 1 wherein the reflector second portion covers a predetermined axial length of the leg of the light source.

4. The light assembly of claim 1 wherein the surface of revolution is dimensioned to substantially cover one end of the light source.

5. A light assembly comprising:

a metal halide light source including a discharge chamber and a first leg extending from the discharge chamber;

a light transmissive capsule surrounding light source; and a reflector received in the capsule having a small diameter portion received around at least a portion of the first leg for mounting the reflector to the light source, and a large diameter portion that receives light from the discharge chamber and is dimensioned to operatively engage an inner surface of the capsule for mounting the reflector and light source relative to the capsule, wherein the reflector is formed of an electrically conductive material and the small diameter end of the reflector serves as a starting aid for the discharge chamber.

6. The light assembly of claim 5 wherein an enlarged end of the reflector is located adjacent the discharge chamber.

7. The light assembly of claim 5 wherein the enlarged end of the reflector is axially spaced from the discharge chamber.

8. The light assembly of claim 5 wherein the reflector fills an annular region between the light source first leg and the capsule and thereby serves as a heat shield for thermally protecting a terminal end of the first leg of the light source.

9. The light assembly of claim 5 wherein the light source includes a second leg extending outward from the discharge chamber in a direction axially opposite the first leg, and further including a lead member that extends along a length of the light source from adjacent a first end to a second end of the light source.

10. The light assembly of claim 9 wherein the reflector is mechanically connected to the lead member.

11. The light assembly of claim 10 wherein the reflector is electrically connected to the lead member.

12. The light assembly of claim 11 wherein the lead member extends through the reflector and is welded thereto.

13. The light assembly of claim 5 wherein the light source further comprises a second leg extending from an axially opposite end of the discharge chamber than the first leg, first and second electrode assemblies including electrodes spaced apart by an arc gap in the discharge chamber, first and second inner leads extending from the first and second electrodes, respectively, and extending through the respective first and second legs for connection with outer lead members.

14. A ceramic metal halide (CMH) light assembly comprising:

a CMH light source having a central discharge chamber, first and second legs extending along an elongated longitudinal axis from opposite ends of the discharge chamber, and first and second electrodes in the discharge chamber separated by an arc gap;

a capsule receiving the CMH light source and having an elongated axis substantially aligned with the CMH light source longitudinal axis, the capsule including a seal at a first end; and a reflector received in the capsule for directing light from the light source in a desired manner from the capsule, an electrically conductive, starting aid portion of the reflector received around the first leg of the light source, and the reflector having an annular portion extending between an inner portion contacting the first leg and an outer portion contacting the capsule for centering the CMH light source in the capsule.

15. The CMH light assembly of claim 14 wherein the reflector is formed from one of niobium and aluminum.

16. The CMH light assembly of claim 15 further comprising an IR reflective coating along a surface of the reflector annular portion facing the discharge chamber.

17. The CMH light assembly of claim 14 wherein the starting aid portion of the reflector includes a generally cylindrical portion extending from the annular inner portion in close proximity to the first leg.

18. The CMH light assembly of claim 14 further comprising first and second lead members extending from the first and second leg portions, respectively, one of the first and second lead members extending through the reflector.

19. The CMH light assembly of claim 14 wherein the starting aid portion of the reflector extends along a longitudinal extent of the first leg.

20. The CMH light assembly of claim 19 wherein the reflector is formed of a material to serve as a heat shield for the seal glass in the first leg and the capsule seal.

* * * * *